United States Patent [19]

Katoh et al.

[11] 4,292,390

[45] Sep. 29, 1981

[54] INTEGRAL DIFFUSION TRANSFER PHOTOGRAPHIC FILM UNIT

[75] Inventors: Kazunobu Katoh; Teruyoshi Makino, both of Minami-asigara, Japan

[73] Assignee: Fuji Photo Film Co., Ltd., Minami-ashigara, Japan

[21] Appl. No.: 154,739

[22] Filed: May 30, 1980

[30] Foreign Application Priority Data

May 30, 1979 [JP] Japan ..... 54-67212

[51] Int. Cl.[3] ..... G03C 1/40; G03C 1/76; G03C 1/48

[52] U.S. Cl. ..... 430/207; 430/215; 430/216; 430/497

[58] Field of Search ..... 430/207, 209, 497, 499, 430/215, 216

[56] References Cited

U.S. PATENT DOCUMENTS

| | | | |
|---|---|---|---|
| 3,256,090 | 6/1966 | Booth | 430/207 |
| 3,761,268 | 9/1973 | Land et al. | 430/207 |
| 3,761,269 | 9/1973 | Campbell | 430/216 |

*Primary Examiner*—Richard L. Schilling
*Attorney, Agent, or Firm*—Sughrue, Mion, Zinn, Macpeak & Seas

[57] ABSTRACT

Integral diffusion transfer photographic film unit is described, comprising at least two support layers, at least one of which is transparent, having laminated therebetween at least one silver halide emulsion layer in association with a dye-image-providing material and an image-receiving layer, and a processing composition to be distributed between the two support layers, wherein at least one marginal portion of the integral film unit is masked by a masking material having formed on at least one surface thereof a pressure-sensitive or heat-sensitive adhesive layer containing an acid or an acid-releasing material.

9 Claims, 2 Drawing Figures

INTEGRAL DIFFUSION TRANSFER PHOTOGRAPHIC FILM UNIT

BACKGROUND OF THE INVENTION

1. Field of the Invention

This invention relates to color diffusion transfer photographic products. More precisely, the invention relates to integral color diffusion transfer photographic film units and, in particular, to improved color diffusion transfer photographic film units capable of providing color prints which retain excellent whiteness in the frame portions of the prints over prolonged periods of time.

2. Description of the Prior Art

Recently, integral color diffusion transfer photographic film units have been developed comprising two dimensionally stable supports, at least one of them being transparent, and, laminated therebetween, a dye-receiving layer and at least one photosensitive silver halide emulsion layer having associated therewith a dye-image-providing material, said integral film unit having been joined together at at least one end thereof. Since the operation of viewing the images prepared therein by imagewise exposure and development using such a photographic film unit becomes simplified, the value of the photographic system for producing so-called one step photographs is now being recognized.

Integral diffusion transfer photographic film units are widely known in the art and are disclosed, for example, in U.S. Pat. Nos. 2,983,605, 3,415,644, 3,415,645, 3,415,646, 3,578,540, 3,573,043, 3,615,421, 3,594,164, 3,594,165, 3,620,724, 3,635,707, and 3,993,486, British Pat. Nos. 1,269,805 and 1,330,524, Japanese Patent Publication Nos. 21660/74 and 21661/74, Belgian Pat. Nos. 757,959 and 757,960, and West German Pat. No. 2,019,430.

Belgian Pat. No. 757,960 discloses a photographic film unit which is composed of a photosensitive sheet and an opaque cover sheet (having associated therewith a pH neutralization system) joined together at an end thereof, said photosensitive sheet comprising a transparent support, an image-receiving layer, a substantially opaque light-reflecting layer (e.g., a $TiO_2$ layer and a carbon black layer), and at least one photosensitive silver halide emulsion layer having associated therewith a dye-image-providing material. After imagewise exposing the photosensitive sheet, the cover sheet is superposed on the photosensitive sheet in a face-to-face relationship, a processing composition is spread between them in order to conduct image development in the light, and the color images transferred in the image-receiving layer can thus be viewed through the transparent support.

Belgian Pat. No. 757,959 discloses a similar photographic film unit to that of Belgian Pat. No. 757,960, but the disclosure differs in that: (1) a transparent cover sheet is used, (2) a photosensitive sheet and the cover sheet are previously fixed at the three sides, (3) after imagewise exposing the photosensitive sheet through the transparent cover sheet, a developer containing an opacifying agent is spread therein from the other side to perform the development in the light, and (4) the color images transferred in the image-receiving layer are viewed through the transparent support.

The practical structures of these photographic film units are described in Japanese Application (OPI) Nos. 153628/75 and 153629/75 (the term "OPI" as used herein refers to a "published unexamined Japanese patent application") and Japanese Patent Application (OPI) Nos. 33630/76 and 137411/76. These publications disclose that a photosensitive sheet and a cover sheet are joined together by adhesion at at least one end thereof through a sheet of a masking material and/or a railing material having on both surfaces thereof pressure-sensitive or heat-sensitive resins having a same or different composition. The masking material is usually in contact with the photosensitive sheet and the railing material in contact with the cover sheet but in an example disclosed therein, only a masking material is used, one surface of the masking material is in contact with the photosensitive sheet, and the other surface is in contact with the cover sheet. This masking material has the functions of maintaining the film unit in an integral state, preventing the processing solution (when the solution is spread in the film unit) from leaking outside the film unit, preventing at the same time the entrance of the processing solution into the peripheral portions of the film unit, and forming a white frame for the color print image formed by the transfer of color materials.

However, although the transfer color print obtained by such a system may have the beautiful white frame thereof directly after development, when the print is preserved for a long period of time, and particularly at a high temperature, the white frame of the print becomes discolor, which reduces greatly the quality of the transfer print.

SUMMARY OF THE INVENTION

An object of this invention is to provide integral diffusion transfer photographic products which are free from discoloration of the peripheral white portions of the film units after development and which particularly provides color prints with white frames which do not become discolor even over prolonged periods of time.

As a result of various investigations on the cause of discoloration in the white frame portions of the color prints in the aforesaid diffusion transfer color photographic system, one of the factors believed to cause degradation of the whiteness of the white frame portions of the print is that the processing solution distributed in the image areas oozes out at the white frame portions over a period of time, and another is that the dye-image-providing material solubilized in the alkali processing solution and the dye released from the dye-image-providing material are transferred into the image-receiving layer and result in discoloration of the frame portions.

Furthermore, as a result of various investigations on discovering a means for preventing the occurrence of discoloration in the white frame portions of the color prints in the aforesaid diffusion transfer color photographic system, it has been found that the diffusion transfer photographic film units of this invention are very effective for the purpose.

That is, the invention provides an integral diffusion transfer photographic film unit comprising two supports, at least one of which is transparent, and, laminated therebetween, at least one photosensitive silver halide emulsion layer in association with a dye-image-providing material and an image-receiving layer, and also containing a processing solution to be distributed between said two supports, wherein at least one end portion of the laminate is masked by a masking material having on at least one surface thereof a pressure-sensitive or heat-sensitive adhesive layer containing an acid or an acid-releasing material. The object of this invention can be attained by the provision of a photo-sensitive film unit according to this invention.

DETAILED DESCRIPTION OF THE INVENTION

Figure 1:
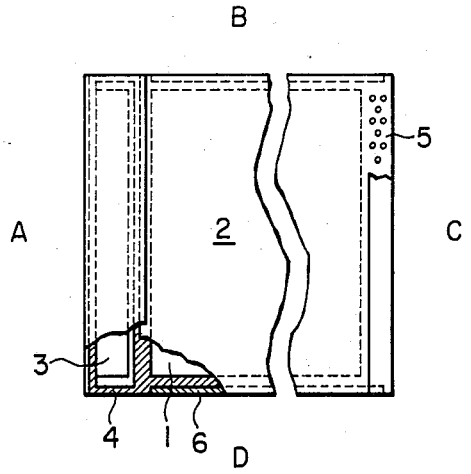
FIG. 1 shows a view of an embodiment of a photographic film unit according to the invention.

The acids or acid-releasing materials that can be used in this invention include the following materials:

(1) Aromatic carboxylic acids and the acid anhydrides thereof, such as benzoic acid, benzoic anhydride, phthalic acid, phthalic anhydride, salicylic acid, $\alpha$-, $\beta$- or $\gamma$-resorcylic acid, etc.

(2) Aliphatic carboxylic acids and the acid anhydrides thereof, such as acetic acid, propionic acid, acetic anhydride, palmitic acid, stearic acid, palmitic anhydride, stearic anhydride, succinic acid, succinic anhydride, etc.

(3) Sulfonic acids and sulfinic acids, such as methanesulfonic acid, benzenesulfonic acid, etc.

(4) Sulfonyl chlorides such as benzenesulfonyl chloride, toluenesulfonyl chloride, etc.

(5) Hydroxylic acids such as resorcinol, ascorbic acid, ascorbic acid monostearate, etc.

(6) Polymeric acids such as polyacrylic acid, a copolymer of acrylic acid and an acrylic acid ester, a copolymer of styrene and maleic anhydride, a polymer containing a lactone ring, and the ring cleavage derivatives thereof.

(7) Inorganic acids, such as phosphoric acid, sulfuric acid, hydrochloric acid, nitric acid, etc.

Of the above-illustrated materials, the aromatic carboxylic acids and the acid anhydrides thereof, and the aliphatic carboxylic acids and the acid anhydrides thereof are particularly effective.

More particularly, the aromatic carboxylic acids such as benzoic anhydride and benzoic acid are particularly preferred owing to their excellent miscibility or compatibility with a solution for a pressure-sensitive or heat-sensitive adhesive added.

It has also been found that depending upon the combination with a pressure-sensitive or heat-sensitive adhesive used together, polymeric acids have good compatibility and can be used effectively.

These acids or acid-releasing materials can be used singly or as mixtures thereof.

Various known materials are used as the pressure-sensitive or heat-sensitive adhesives in this invention. The use of pressure-sensitive adhesives is, however, particularly preferred in the point of continuously assembling photographic film units of this invention using these masking materials.

Various heat-sensitive adhesives are known in the field of the arts and many such adhesives are commercially available. One of these adhesives is vinyl acetate resins and, in particular, copolymer resins of vinyl acetate and ethylene are well known, which are commercially available in the form of powders, solutions, or emulsions. Various copolymerization ratios of vinyl acetate and ethylene are used but the copolymers containing from about 18 to 40% by weight vinyl acetate are usually preferred. Practical examples of such copolymers are ELVAX-150 (containing 33% by weight vinyl acetate), ELVAX-220 (containing 28% by weight vinyl acetate), ELVAX-250 (containing 28% by weight vinyl acetate), and ELVAX-260 (containing 28% by weight vinyl acetate) (all being the registered trademarks, made by E. I. Du Pont de Nemours and Company); ELVACE-1872 (55% in solid content, 0.2–1 micron in mean particle size, and 1200–1700 cps in emulsion viscosity), ELVACE-1873 (55% in solid content, 0.2–1 micron in mean particle size, and 1200–1700 cps in emulsion viscosity), ELVACE-1875 (55% in solid content, 0.2–1 micron in mean particle size, and 1400–2000 cps in emulsion viscosity), ELVACE-PB 3-1962 (50% in solid content, 0.2–1 micron in mean particle size, and 200–600 cps in emulsion viscosity), and ELVACE-PB 3-1965 (50% in solid content, 0.2–1 micron in mean particle size, and 2000–3000 cps in emulsion viscosity) (all being registered trademarks, made by E. I. Du Pont de Nemours and Company); Sumika Flex-400 (55% in solid content, 0.2–1 micron in mean particle size, and 1100–1600 cps in emulsion viscosity), Sumika Flex-100 HS (55% in solid content, 0.17 micron in mean particle size, and 300–700 cps in emulsion viscosity), Sumika Flex-500 (55% in solid content, 0.17 micron in mean particle size, and 200–600 cps in emulsion viscosity), and Sumika Flex-510 (55% in solid content, 0.3 micron in mean particle size, and 200–600 cps in emulsion viscosity) (all being registered trademarks, made by Sumitomo Chemical Industries Co., Ltd.); and other various copolymers of vinyl monomers and vinyl acetate. Copolymerizable vinyl monomers that can be used for the purpose include acrylate esters, vinyl chloride, vinylidene chloride, dibutyl maleate, other dialkyl maleates, fumaric acids, crotinic acids, acrylic acids, methacrylic acids, itaconic acids, vinylpyrrolidone, etc. When a monomer is not copolymerized with vinyl acetate directly, the monomer can be graft-polymerized with vinyl acetate by using a third monomer.

Other examples of pressure-sensitive adhesives include copolymer resins of ethylene and ethyl acrylate and copolymer resins of ethylene and acrylic acid.

Also, many other adhesives may be used, such as synthetic rubbers (e.g., Neoprene, styrene-butadiene copolymer resin, butyl rubber, etc.), natural rubber, polyvinyl alcohol, polyvinylacetals, adhesives based on polyurethane and isocyanate, epoxy resins, amino resins, phenol resins, and so forth.

These known adhesives are described in, for example, Irving Sjeist, *Handbook of Adhesives,* 2nd Edition, Van Nostrand Reinhold Co., (1977). Other examples of commercially available adhesives are described in Secchaku Kenkyu Kai edited, *Kogyo yo Secchaku Zai Katarogu Shu* (*Catalogs for Industrial Adhesives*), Kobunshi Kagaku Kanko Kai (1977). Other adhesives effectively used in this invention are also described in *Research Disclosure,* No. 16620 (1978), Japanese Patent Application (OPI) Nos. 50728/78 and 116822/78 and U.S. Pat. No. 4,126,464.

Practical examples of the adhesive layer compositions using these adhesives are described, for example, in Japanese Patent Publication Nos. 805/67, 37917/71, 9667/70, 21989/68 and 2104/70 for pressure-sensitive adhesive layer and in Japanese Patent Application (OPI) No. 47931/73 and Japanese Patent Publication Nos. 21720/72 and 8697/74 for heat-sensitive adhesive layer.

For controlling the softness, strength, cohesion, elasticity, etc., of adhesive layers and for giving stable adhesive power to the adhesive layers in various temperature and humidity ranges, it is effective to incorporate in these adhesive layers such adhesion aids as wood rosin and the derivatives thereof, hydrocarbon resins, polyterpene resins, low molecular weight polystyrene and copolymers thereof, and phenol resins. Furthermore, waxes such as paraffin wax, microcrystalline wax, organic wax and synthetic wax may be added to these adhesive layers.

Also, inorganic or organic colored or colorless pigments may be incorporated in the adhesive layers as fillers.

It is also effective for preventing the deterioration of adhesive resins to incorporate in the adhesive layers an antioxidant, such as 2,6-di-t-butylphenol, 2,6-t-butyl-p-cresol, 2,2'-methylenebis(4-methyl-6-t-butylphenol), and so forth.

It is also preferred for controlling the softness of the adhesive layers to incorporate known plasticizers such as tricresyl phosphate, diisooctyl isophthalate, di(2-ethylhexyl)adipate, polyester, triethylene glycol di(2-ethylene hexonate), etc.

For preparing the masking material, an adhesive composition containing the above-described adhesives is coated on at least one surface of a support, for example, a paper such as an ordinary paper, a laminated paper, an impregnated paper, etc.; a polyester film such as polyethylene terephthalate film, etc.; a cellulose ester film such as a cellulose acetate film, or a polymer film such as a polycarbonate film, a polyethylene film, a polypropylene film, etc., at at least adhesion portions of the masking material.

The thickness of the masking material depends on the thickness of a processing composition to be spread in the film unit, and it is necessary that the masking material has a proper thickness for providing a proper thickness of a processing composition spread in the film unit. Depending upon the necessary thickness of the processing composition to be spread, the thickness of the support for the masking material and the thickness of the coated layer of the adhesive composition are controlled. If necessary, the film support for the masking material can contain a pigment such as titanium dioxide, carbon black, etc., for light-piping prevention. Furthermore, in the case of using a polymer film as the support for masking material, it is desirable to control or improve the hydrophilic property or wetting property of the surface of the film by applying thereto a corona discharging treatment, or applying thereover an anchoring coating.

The adhesive layer is formed by dissolving the adhesive resin as illustrated above and, if necessary, other additives in a proper solvent determined by the kind of the adhesive resin employed, such as acetone, toluene, methyl ethyl ketone, alcohol, etc., and coating the solution by dip coating, roller coating, gravure coating, doctor coating, extrusion coating, etc., on a film support followed by drying. Also, in the case of using an adhesive resin insoluble in water, the adhesive resin is finely dispersed in water to form a latex and the latex is coated on the support by the aforesaid manner. In the case of using a hot-melt type adhesive, the adhesive resin is melted by heating and extruded onto a support through a die.

The silver halide emulsion used in this invention is a hydrophilic colloid dispersion of silver chloride, silver bromide, silver chlorobromide, silver iodobromide, silver chloroiodobromide or a mixture of them and the halogen composition is selected according to the purposes of the photographic materials and the processing conditions for them. The grain sizes of silver halide used may be those oridinarily used, but it is preferred that the mean grain size be in the range of from about 0.1 micron to about 2 microns. Furthermore, according to the purposes of the photographic materials, it is desirable that the silver halide has uniform grain sizes. The crystal form of silver halide grains used in this invention may be a cubic, octahedral, or a mixed crystal system. These silver halide emulsions can be prepared by the conventional methods, as are described in detail in P. Glasfkides, *Chimie Photographique,* 2nd Edition, Chapters 18–23, 1957, Paul Montel, Paris.

It is preferred that the silver halide emulsions used in this invention are chemically sensitized by the combination of heat treatment and the use of a natural sensitizer contained in gelatin; a sulfur sensitizer such as sodium thiosulfate, N,N,N'-triethylthiourea, etc.; a gold sensitizer such as a thiocyanate complex salt or a thiosulfate complex salt of monovalent gold; or a reduction sensitizer such as stannous chloride or hexamethylenetetramine. In this invention silver halide emulsions of a type that latent images are liable to form on the surface of the silver halide grains are used, and the internal latent image type direct reversal silver halide emulsions described in U.S. Pat. Nos. 2,497,875, 2,588,982, 2,456,953, 3,761,276, 3,206,313, 3,317,322, 3,761,266, 3,850,637, 3,923,513, 3,736,140, 3,761,267 and 3,854,949 are preferably used.

Silver halide emulsions used in this invention can be stabilized by a conventional stabilizing agent. Furthermore, the silver halide emulsions used may contain a sensitizing compound such as a polyethylene oxide compound.

The silver halide emulsions used in this invention may further, if desired, be spectrally sensitized. Useful spectral sensitizers include cyanines, merocyanines, holopolar cyanines, styryls, hemicyanines, oxanoles, hemioxanoles, etc. Practical examples of the spectral sensitizers are described in P. Glafkides, *Chimie Photographique,* 2nd Edition, Chapters 35–41 and F. M. Hamer, *The Cyanine and Related Compounds.* In particular, the cyanines wherein the nitrogen atom of the basic heterocyclic nuclei has been substituted by a hydroxy group, a carboxy group or an aliphatic group (e.g., alkyl group) having sulfo group, such as those described in U.S. Pat. Nos. 2,503,776, 3,459,553 and 3,177,210 are useful for the practice of this invention.

Diffusion transfer dye-image-providing materials used in combination of the silver halide photographic emulsions in this invention can include the compounds described, for example, in U.S. Pat. Nos. 3,227,551, 3,227,554, 3,443,939, 3,443,940, 3,658,524, 3,698,897, 3,725,062, 3,728,113, 3,751,406, 3,929,760, 3,931,144, 3,932,381, and 3,719,489, British Pat. Nos. 840,731, 904,364 and 1,038,331, West German Patent Application (OLS) Nos. 1,930,215, 2,214,381, 2,228,361, 2,242,762, 2,317,134, 2,402,900, 2,406,626, and 2,406,653, Japanese Patent Application (OPI) Nos. 114424/74, 111628/74, 126332/74, 33862/73, 126331/74, 115528/75, 63618/76, 113624/76, 104343/76, 8827/77, 106727/77, 114930/76 and 23628/78 and Japanese Patent Application (OPI) Nos. 143323/78, 149328/78, 8627/79 and 65034/79. Of these compounds, dye-image-providing materials of a type which is originally non-diffusible but which is cleaved after causing an oxidation reduction reaction with the oxidation product of a developing agent to form a dye image-providing material (hereinafter, these materials are referred to as DRR compounds) are preferably used.

Preferred dye-image-providing materials used in this invention are shown by the following formula (I):

$$Y\text{-}X \qquad (I)$$

wherein X represents a dye residue or a dye precursor residue bonded to Y directly or via a linking group —Z—, wherein —Z— represents a linking group such as alkylene group (or akylidene group) having from 1 to 6 carbon atoms, arylene group or heterocyclic group; said linking group —Z— is bonded to X directly or via an —O—, —S—, $—SO_2—$, $—NR_o—$ (wherein $R_o$ is hydrogen or an alkyl group), —CO—, —CO—NH—, or $—SO_2—NH—$ group.

The above-described dye residue may be in principle a residue of any desired dye. This dye residue must have a sufficient diffusibility for reaching an image-receiving layer through silver halide photographic emulsion layers in a photographic material. For the purpose, one or more water-solubility-imparting groups may be bonded to the dye residue. Examples of the proper water-solubility-imparting groups are a carboxy group, a sulfo group, a sulfonamido group, a sulfamoyl group, and an aliphatic or aromatic hydroxy group. When Y is a sulfamoyl group, the group can impart a considerably high diffusibility in an alkaline medium to the dye molecule after finishing the decomposition reaction of a redox compound, and hence it is not always necessary to additionally bond another water-solubility-imparting group. Examples of the particularly suitable dyes are azo dyes, azomethine dyes, anthraquinone dyes, phthalocyanaine dyes, indigoid dyes, triphenylmethane dyes, metal complex dyes, and organic metal complexes.

By the aforesaid term "dye precursor residue" is meant a residue of a compound capable of being converted to a dye by the liberation of an auxochrome (i.e., the phenomenon that the auxochrome is liberated and participates in a chromophore) within a coloring system by oxidation in an ordinary processing stage or an additional processing stage of photographic processing steps. The dye precursor in this case may be a leuco dye or a dye which is converted into other dye during photographic processing.

Y in general formula (I) represents a moiety providing a dye compound having different diffusibility than that of the dye-image-providing material shown by general formula (I) as the result of development under an alkaline condition.

The effective moiety shown by Y in the compound of formula (I) is N-substituted sulfamoyl group. As an example of the moiety Y, mention may be made of moiety represented by the following formula (A):

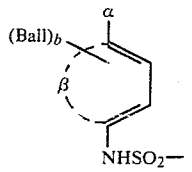

(A)

Therein, β represents the nonmetal atoms necessary to form a benzene ring, which benzene ring may be condensed with a carbocyclic ring or a heterocyclic ring to form a condensed ring such as naphthalene ring, a quinoline ring, a 5,6,7,8-tetrahydronaphthalene ring, a chroman ring and so on. Further, the above-described benezene ring may be substituted with a halogen atom, an alkyl group, an alkoxy group, an aryl group, an aryloxy group, a nitro group, an amino group, an alkylamino group, an arylamino grup, an amido group, a cyano group, an alkylmercapto group, a keto group, a carboalkoxy group, a hetero ring residue (to which some substituents may be attached) or so on.

α represents a group of the formula $—OG^1$ or $—NHG^2$. Therein, $G^1$ represents a hydrogen atom or a group capable of producing a hydroxy group when hydrolyzed (a hydrolyzable group), with preferable examples including $$-\overset{O}{\overset{\|}{O}}G^3$$

and groups represented by the formula $$-\overset{O}{\overset{\|}{C}}-O-G^3$$

(wherein $G^3$ represents an alkyl group having 1 to 18 carbon atoms particularly methyl, ethyl, propyl, etc.; a halogen substituted alkyl group having 1 to 18 carbon atoms such as chloromethyl, trifluoromethyl, etc.; a phenyl group or a substituted phenyl group). On the other hand, $G^2$ represents a hydrogen atom, an alkyl group having 1 to 22 carbon atoms or a hydrolyzable group. Preferred examples of the hydrolyzable group represented by $G^2$ include a group of the formula $$-\overset{O}{\overset{\|}{C}}G^4,$$

a group of the formula $—SO_2G^5$ and $—SOG^5$. Therein, $G^4$ represents an akyl group containing 1 to 4 carbon atoms such as a methyl group; a halogen substituted alkyl group such as a mono-, di- or trichloromethyl group, or a trifluoromethyl group; an alkylcarbonyl group such as an acetyl group; an alkyloxy group; a substituted phenyl group such as a nitrophenyl or a cyanophenyl group; a phenyloxy group per se or a phenyloxy group substituted with a lower alkyl group or a halogen atom; a carboxyl group; an alkyloxycarbonyl group; an aryloxycarbonyl group; an alkylsulfonylethoxy group; or an arylsulfonylethoxy group. On the other hand, $G^5$ represents a substituted or an unsubstituted alkyl group or an aryl group.

In addition, b represents an integer of 0, 1 or 2. Therein, b must be 1 or 2 and is preferably 1 except when α represents the group $—NHG^2$ and $G^2$ contains a group (equivalent to an alkyl group) which renders the compound immobile and nondiffusible (i.e., b is 1 or 2 when α represents a group of the formula $—OG^1$ or a group of the formula $—NGH^2$ and $G^2$ represents a hydrogen atom, an alkyl group having 1 to 8 carbon atoms or a hydrolyzable group).

"Ball" represents a ballast group, which will be described in more detail hereinafter.

Specific examples of the moiety Y of the above-described kind are described in Japanese Patent Application (OPI) No. 50736/78 and U.S. Pat. No. 3,928,312.

Another example of the moiety Y suitable for a dye-releasing redox compound may be made represented by the following formula (B):

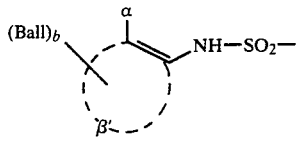

(B)

wherein Ball, $\alpha$ and b, respectively, have the same meanings as in the formula (A), and $\beta'$ represents atoms necessary to form a carbocyclic ring such as a benzene ring, which ring may be condensed with a carbocyclic ring or a heterocyclic ring to form a condensed ring system such as a naphthalene ring, a quinoline ring, a 5,6,7,8-tetrahydronaphthalene ring, a chroman ring, etc. Further, each of the above-described rings may be substituted with a hologen atom, an alkyl group, an alkoxy group, an aryl group, an aryloxy group, a nitro group, an amino group, an alkylamino group, an arylamino group, an amido group, a cyano group, an alkylmercapto group, a keto group, a carboalkoxy group, a heterocyclic ring (which may be further substituted), etc. Specific examples of the moiety Y of the above-described kind are described in U.S. Pat. Nos. 4,053,312 and 4,055,428.

Another example of Y is a moiety represented by the formula (C):

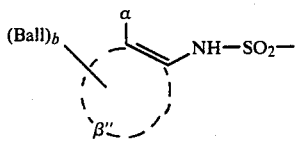

(C)

wherein Ball, b and $\alpha$, respectively, have the same meanings as in the formula (A), and $\beta''$ represents the atoms necessary to form a heterocyclic ring such as a pyrazole ring, a pyridine ring or the like, which may be condensed with a carbocyclic ring or a heteocyclic ring. In addition, each of the above-described various rings may be substituted with the same kinds of substituents as described for the rings in the formula (B). Specific examples of this Y moiety are described in Japanese Patent Application (OPI) No. 104343/76.

As a further example of Y there is the moiety represented by the formula (D):

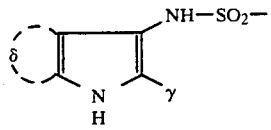

(D)

wherein $\gamma$ preferably represents a hydrogen atom, or an alkyl group, an aryl group or a heterocyclic ring residue, which may be substituted or unsubstituted, or a —CO—$G^6$ group where $G^6$ represents —$OG^7$, —$SG^7$ or

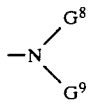

(wherein $G^7$ represents a hydrogen atom, an alkyl group, a cycloalkyl group or an aryl group, which groups each may bear substituents; $G^8$ has the same definition as $G^7$ or an acyl group derived from an aliphatic or an aromatic carboxylic acid or from a sulfonic acid; and $G^9$ represents a hydrogen atom or a substituted or unsubstituted alkyl group); and $\delta$ represents the atoms necessary to complete a condensed benzene ring and further the condensed benzene ring completed may bear one or more of substitutents; and $\gamma$ and/or the condensed benzene ring completed by the moiety $\delta$ must bear a ballast group or a group containing a ballast group. Specific examples of this Y moiety are described in Japanese Patent Application (OPI) Nos. 104343/76, 130122/79 and 46730/78.

As another example of the Y moiety suitable for the compound, mention may be made of the moiety represented by the formula (E):

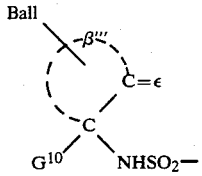

(E)

In the formula (E), Ball has the same meaning as in the formula (A), and $\epsilon$ represents an oxygen atom or $=NG^{11}$ (where $G^{11}$ represents a hydroxy group or an amino group which may be substituted). In case of $\epsilon=NG^{11}$, the $=C=N-G^{11}$ group is formed by dehydration reaction of a carbonyl compound of the formula $H_2N-G^{11}$ with a ketone group. $G^{11}$ is determined by the compounds of the formula $H_2N-G^{11}$ employed as the carbonyl reagent. Representative examples are hydroxylamine, hydrazines, semicarbazides, thiosemicarbazides and the like. Specific examples of hydrazines include hydrazine; phenylhydrazine and substituted phenylhydrazines whose phenyl moiety bears a substitutent such as an alkyl group, an alkoxy group, a carboalkoxy group, a halogen atom, etc.; isonicotinic acid hydrazide; and the like. Specific examples of semicarbazides include, by analogy to hydrazines, phenylsemicarbazide and substituted phenyl-semicarbazides whose phenyl moiety bears a substituent such as an alkyl group, an alkoxy group, a carboalkoxy group, a halogen atom, etc., and specific examples of thiosemicarbazides also include various derivatives similar to those of the semicarbazides.

$\beta'''$ in the formula (E) represents the atoms necessary to form a 5-, 6- or 7-membered saturated or unsaturated non-aromatic hydrocarbon ring with specific examples including cyclopentanone, cyclohexanone, cyclohexenone, cyclopentenone, cycloheptanone, cycloheptenone and the like. In addition, the above-described non-aromatic hydrocarbon rings may be further fused with other carbocyclic, heterocyclic or aromatic rings at appropriate positions thereon to form a condensed system. However, when $\beta'''$ forms a condensed ring, a condensed ring formed by benzene and the above-described 5- to 7-membered non-aromatic hydrocarbon ring such as indanone, benzocyclohexenone, benzocycloptenone and the like, is more desirable in the present invention.

The above-described 5- to 7-membered non-aromatic hydrocarbon rings and the above-described condensed rings may bear one or more substitutents such as as alkyl group, an aryl group, an alkyloxy group, an aryloxy group, an alkylcarbonyl group, an arylcarbonyl group, an alkylsulfonyl group, an arylsulfonyl group, a halogen atom, a nitro group, an amino group, an alkylamino group, an arylamino group, an amido group, an alkylamido group, a arylamido group, a cyano group, an alkylmercapto group, an alkyloxycarbonyl group, etc.

$G^{10}$ represents a hydrogen atom or a halogen atom such as fluorine, chlorine, bromine or the like.

Specific examples of this Y moiety are described in Japanese Patent Application (OPI) No. 3819/78.

As other examples of the suitable Y moieties for diffusible dye-providing compounds are described in U.S. Pats. No. 3,443,930, 3,443,939, 3,628,952, 3,844,785 and 3,443,943, etc.

Formula (I) also represents non-diffusible, dye-providing compounds that can release a diffusible dye through self-ring-closure under an alkaline condition, but stops substantially releasing the dye as a result of the reaction with the oxidized developer. The diffusiblility controlling Y moiety effective for these compounds can be represented by the following formula (F):

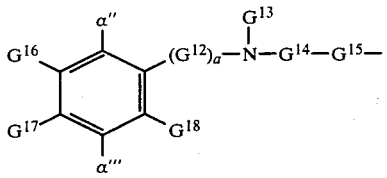

(F)

In the formula (F), $\alpha''$ represents an oxidizable nucleophilic group such as a hydroxyl group, a primary or a secondary amino group, a hydroxyamino group, a sulfonamido group or the like, or the precursor thereof and is preferably a hydroxyl group.

$\alpha'''$ represents a dialkylamino group or one of the groups defined in $\alpha''$ and is preferably a hydroxyl group.

$G^{14}$ represents an electrophilic group such as —CO—, —CS— or the like, and is preferably —CO—.

$G^{15}$ represents an oxygen atom, a sulfur atom, a selenium atom, a nitrogen atom or the like, wherein the nitrogen atom may be substituted with a hydrogen atom, an unsubstituted or substituted alkyl group having 1 to 10 carbon atoms or an aryl group having 6 to 20 carbon atoms. An oxygen atom is preferred as $G^{15}$.

$G^{12}$ represents an alkylene group having 1 to 3 carbon atoms.

a represents 0 to 1 and referably 0.

$G^{13}$ represents a subsituted or an unsubstituted alkyl group having 1 to 40 carbon atoms, or a substituted or an unsubstituted aryl group having 6 to 40 carbon atoms and is preferably an alkyl group.

$G^{16}$, $G^{17}$ and $G^{18}$ each represents a hydrogen atom, a halogen atom, a carbonyl group, a sulfamoyl group, a sulfonamido group, an alkyloxy group having 1 to 40 carbon atoms or the same groups as defined for $G^{13}$. $G^{16}$ and $G^{17}$ may combine with each other to form a 5- to 7-membered ring. In addition, $G^{17}$ may represent $$-(G^{12})_a-\underset{\underset{G^{13}}{|}}{N}-G^{14}-G^{15}-.$$

Therein, at least one of groups $G^{13}$, $G^{16}$, $G^{17}$ and $G^{18}$ must be a ballast group. Specific examples of this Y moiety are described in U.S. Pat. No. 3,980,479.

Another examples of a Y moiety suitable for the non-diffusible dye-providing compound is represented by the formula (G):

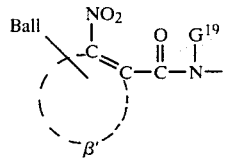

(G)

wherein Ball and $\beta'$ have the same meanings as defined in the formula (B), respectively, and $G^{19}$ represents an alkyl group (including substituted alkyl groups).

Specific examples of this Y moiety are described in Japanese Patent Application (OPI) No. 35533/78.

Still another example of this Y moiety suitable for the compounds of this invention is represented by the following general formula (H):

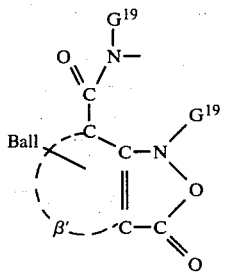

(H)

wherein Ball and $\beta'$ have the same meanings as defined in the formula (B), respectively, and $G^{19}$ has the same meaning as defined in the formula (G). Specific examples are described in Japanese Patent Application (OPI) No. 4819/77 and U.S. Pat. No. 3,421,964.

The ballast group is an organic ballast group which can make the dye-releasing redox compound non-diffusible even during development in an alkaline processing solution and is preferably a group containing a hydrophobic group having 8 to 32 carbon atoms. Such an organic ballast group is bonded to the dye-releasing redox compound directly or via a linking group (for example, an imino bond, an ether bond, a thioether bond, a carbonamido bond, a sulfonamido bond, a ureido bond, an ester bond, an imido bond, a carbamoyl bond, a sulfamoyl bond, etc., solely or as a combination thereof).

Practical examples of the ballast groups are illustrated below:

That is, there are an alkyl group, an alkenyl group (e.g., dodecyl group, octadecyl group, etc.), an alkoxyalkyl group (e.g., 3-(octyloxy)propyl group,a 3-(2-ethylundecylosy)propyl group, etc., as described in Japanese Patent Publication No. 27563/64), an alkylaryl group (e.g., a 4-nonylphenyl group, a 2,4-di-tert-butylphenyl group, etc.), an alkylaryloxyalkyl group (e.g., a 2,4-di-tert-pentylphenoxymethyl group, an $\alpha$-(2,4-di-tert-pentylphenoxy)propyl group, a 1-(3-pentadecylphenoxy)ethyl group, etc.), an acylamidoalkyl group (e.g., the groups as described in U.S. Pat. Nos. 3,337,344 and 3,418,129 as well as 2-(N-butylhexadecanamido)ethyl group, etc.), an alkoxyaryl group or an aryloxyaryl group (e.g., a 4-(n-octadecyloxy)phenyl group, a 4-(4-n-dodecylphenyloxy)phenyl group, etc.), a residue having an alkyl or alkenyl long chain aliphatic group and a water-solublizing group such as a carboxy group or a sulfo group (e.g., a 1-carboxymethyl-2-nonanedecenyl group, a 1-sulfoheptadecyl group, etc.), an alkyl group substituted by ester group (e.g., a 1-ethoxycarbonylheptadecyl group, a 2-(n-dodecyloxycarbonyl)ethyl group, etc.), an alkyl group substituted by an aryl group or a heterocyclic group (e.g., a 2-[4-(3-methoxycarbonyluneicosanamido)phenyl]ethyl group, a 2-[4-(2-n-octadecylsuccinimido)phenyl]ethyl group, etc.), and an aryl group substituted by an aryloxyalkoxycarbonyl group (e.g., a 4-[2-(2,4-di-tert-pentylphenyloxy)-2-methylpropyloxycarbonyl]phenyl group, etc.).

Of the above-described ballast groups, particularly preferred ones are those bonded to the linking group as represented by the following general formulae:

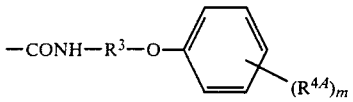

(II)

$-CONH-R^3-O-R^{4B}$ (III)

$-O-R^5$ (IV)

$-CONHR^{4B}$ (V)

$-CONR^{4B}R^6$ (VI)

wherein $R^3$ represents an alkylene group having 1 to 10 carbon atoms, preferably 1 to 6 carbon atoms, such as a propylene group, a butylene group, etc.; $R^{4A}$ represents a hydrogen atom or an alkyl group having 1 to 10 carbon atoms, preferably 1 to 6 carbon atoms, such as a tertamyl group; m is an integer of 1 to 5 (preferably 1 or 2); $R^{4B}$ represents an alkyl group having 4 to 30 carbon atoms, preferably 10 to 20 carbon atoms, such as dodecyl group, a tetradecyl group, a hexadecyl group, etc.; $R^5$ represents an alkyl group having 8 to 30 carbon atoms, preferably 10 to 20 carbon atoms (e.g., a hexadecyl group, an octadecyl group, etc.) or a substituted alkyl group having 8 or more carbon atoms (the alkyl residue having one or more carbon atoms and examples of the substituent being a carbamoyl group, etc.); and $R^6$ has the same significance as $R^4$.

The particularly effective group as Y for the aforesaid compounds is an N-substituted sulfamoyl group. A preferred N-substituent for the N-substituted sulfamoyl group is a carbon ring group or a heterocyclic ring group. Particularly preferred examples of the N-carbon ring-substituted sulfamoyl group are those shown by formula (A) and formula (B) and particularly preferred examples of the N-heterocyclic ring-substituted sulfamoyl group are those shown by formula (C) and formula (D).

Examples of the dye-releasing redox compounds are described in, for example, U.S. Pat. Nos. 4,076,529, 4,152,153, 3,928,312, 3,993,638, 4,055,428 and 3,942,987, Japanese Patent Application (OPI) Nos. 104343/76, 46730/78 and 47823/78, *Research Disclosure,* Vol. 151, No. 15157 (1976, November), ibid., Vol. 130, No. 13024 (1975, February), and ibid., Vol. 156, No. 15654 (1977, April).

Practical examples of the dye-releasing redox compounds are illustrated below in addition to those described in the examples of this invention:

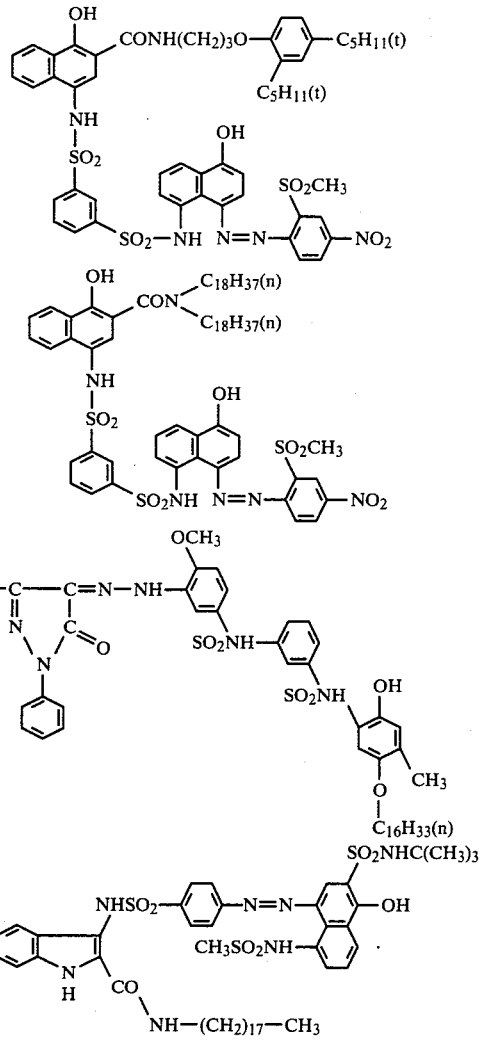

The dye-releasing redox compound may be in a silver halide emulsion layer or in a layer adjacent to the silver halide emulsion layer.

The proper coated amount of the dye-releasing redox compound is $1\times10^{-4}$ to $1\times10^{-2}$ mol/m², preferably $2\times10^{-4}$ to $2\times10^{-3}$ mol/m².

When DRR compounds are used in this invention, any silver halide developing agent which can cross-oxidize these compounds can be used. Such a developing agent may be incorporated in an alkaline processing composition (processing element) or in a proper layer of a photo-sensitive element. Examples of developing agents used in this invention are as follows: hydroquinone, aminophenol such as N-methylaminophenol, etc., 1-phenyl-3-pyrazolidone, 1-phenyl-4,4-dimethyl-3-pyrazolidone, 1-phenyl-4-methyl-4-oxymethyl-3-pyrazolidone, N,N-diethyl-p-phenylenediamine, 3-methyl-N,N-diethyl-p-phenylenediamine, and 3-methoxy-N-ethoxy-p-phenylenediamine.

Of the above-illustrated developing agents, black and white developing agents possessing a property of reducing the formation stain in image-receiving layer (mordant layer) are particularly preferred.

In the practice of this invention, when so-called conventional type silver halide emulsions causing development according to the exposure amount are used in the case of using DRR compounds, negative images are formed as transfer images and positive images as remaining images. On the other hand, when so-called direct reversal silver halide emulsions which are developed at non-exposed areas (e.g., internal latent image forming type silver halide emulsions or solarization type silver halide emulsions) are used, positive images are formed in the image-receiving portion of a film unit.

The above-described solarization type silver halide emulsions useful in this invention are described in, for example, Mees, *The Theory of the Photographic Process*, pp. 261–297 (1942, Macmillan Co., New York). Processes of preparing these silver halide emulsions are described, for example, in British Pat. Nos. 443,245 and 462,730 and U.S. Pat. Nos. 2,005,837, 2,541,472, 3,367,778, 3,501,305, 3,501,306 and 3,501,307.

The internal latent image type direct positive silver halide emulsions advantageously used in this invention are described in the U.S. Pat. Nos. 2,497,875, 2,588,982, 2,456,953, 3,761,276, 3,206,313, 3,317,322, 3,761,266, 3,850,637, 3,923,513, 3,736,140, 3,761,267 and 3,854,949.

The direct reversal photographic silver halide emulsions used in this invention can provide direct positive images by developing the photographic material having the photographic silver halide emulsion layers, after imagewise exposure, in the presence of a fogging agent, or fogging the photographic silver halide emulsion layers by overall uniform exposure (high intensity short period exposure, i.e., an exposure for shorter than $10^{-2}$ second, or low intensity long period exposure) of the emulsion layers during surface development processing after imagewise exposure as described in U.S. Pat. No. 2,456,953 (Knott and Stevens). It is preferred to use a fogging agent in the point that the fogging extent can be easily controlled. The fogging agent may be incorporated in photographic materials or a developer but the former case is more preferred. Examples of the fogging agent for this type of silver halide emulsions are the hydrazines described in U.S. Pat. Nos. 2,588,982 and 2,568,785, hydrazide and hydrazone described in U.S. Pat. No. 3,227,552; the quaternary salt compounds described in British Pat. No. 1,283,835, Japanese Patent Publication No. 38164/74 and U.S. Pat. Nos. 3,734,738, 3,719,494, and 3,615,615 and the acylhydrazinophenylthiourea compounds described in West German Patent Application (OLS) No. 2,635,316.

The amount of the fogging agent used may be changed in a wide range according to the desired results or purposes.

The fogging agent may be incorporated in a developer. When the fogging agent is incorporated in any one of photographic emulsion layers of a photographic material, it is effective for the purpose to make the fogging agent non-diffusible. As a means for making the fogging agent non-diffusible, it is effective to bond a ballast group which is ordinary used for couplers to the fogging agent.

Furthermore, transfer positive images can be obtained in this invention by a DIR reversal silver halide emulsion system as described in U.S. Pat. Nos. 3,227,551, 3,227,554, 3,364,022, etc.; or the reversal silver halide emulsion system by a dissolution development phenomenon as described in British Pat. No. 904,364. A series of processes are described for obtaining color diffusion transfer images in U.S. Pat. Nos. 3,227,550 and 3,227,552 and British Pat. No. 1,330,524.

The two supports used in this invention are plastic films which do not cause severe dimensional distortion during photographic processing. Examples of such supports are a cellulose acetate film, a polystyrene film, a polyester film (e.g., polyethylene terephthalate film, etc.), a polycarbonate film, etc., which is ordinarily used for photographic materials. The supports may contain a very small amount of a light-scattering or light-absorbing pigment such as titanium dioxide, carbon black, etc., or the dyes disclosed in Japanese Patent Applicatin (OPI) Nos. 37725/79 and 37726/79, Japanese Patent Application (OPI) Nos. 14245/72 and 34958/73, Japanese Patent Publication No. 8735/72, British Pat. No. 1,287,479, and U.S. Pat. Nos. 2,622,026, 3,728,124 and 3,822,132.

The polyester films having good dimensional stability and high water permeability disclosed in Japanese Patent Application (OPI) No. 101417/78 and Japanese Patent Application (OPI) No. 14188/79 can be used in this invention.

The processing solution used in this invention is a liquid compositon containing processing components necessary for developing silver halide emulsions and forming diffusion transfer dye images. The main solvent thereof is water which may contain a hydrophilic solvent such as methanol, methyl cellosolve, etc. The processing solution contains an alkali of an amount sufficient for keeping the pH necessary for causing the development of silver halide emulsion layers and for neutralizing the acid (e.g., hydrohalogenic acid such as hydrobromic acid, etc., or a carboxylic acid such as acetic acid) formed during processings of forming dye images. As the alkali, there are alkali metal salts, alkaline earth metal salts, and amines such as lithium hydroxide, sodium hydroxide, potassium hydroxide, calcium hydroxide dispersion, tetramethylammonium hydroxide, sodium carbonate, trisodium phosphate, diethylamine, etc. It is preferred that the processing composition contains an alkali hydroxide at a concentration of higher than about 10 pH, preferably higher than about 12 pH at room temperature. More preferably, the processing composition contains a hydrophilic polymer such as high molecular weight polyvinyl alcohol, hydroxyethyl cellulose, sodium carboxymethyl cellulose, etc. These polymers not only to give a viscosity of higher than 1 poise, preferably about several hyndreds (500–600) to about 1,000 poise to the processing composition to make easy the uniform spreading of the processing composition at processing but also to form a non-fluid film when the aqueous medium moves from the processing composition to the photosensitive element and the image-receiving element in the stage of processing and the processing composition is thus concentrated there to assist unifying the film unit after processing. The polymer film also contributes to preventing the deterioration of images by restraining the further transfer of coloring components into the image-receiving layer after the formation of diffusion transfer dye images is substantially finished.

It is advantageous that the processing compositions used in this invention further contain $TiO_2$, carbon black, pH indicator or other light absorptive materials or the desensitizers described in U.S. Pat. No. 3,579,333 for preventing the silver halide emulsion layers from fogged by external light during processing. Furthermore, the processing compositions used in this invention may further contain development inhibitors such as benzotriazole, etc.

The processing composition described above is preferably used in a rupturable container as described in U.S. Pat. Nos 2,543,181, 2,643,886, 2,653,732, 2,723,051, 3,056,491, 3,056,492 and 3,152,515.

The image-receiving layer used in this invention is a layer joining together therein diffused transfer dyes and various known mordanting layers can be used.

Practical examples of the mordant are nitrogen-containing secondary or tertiary amines, nitrogen-containing heterocyclic compounds or the quaternary cationic compounds thereof.

U.S. Pat. Nos. 2,548,564, 2,484,430, 3,148,061 and 3,756,814 disclose vinylpyridine polymers and vinylpyridinium cation polymers.

U.S. Pat. No. 2,675,316 also discloses the use of a polymer containing a dialkylamino group as a mordant.

U.S. Pat. No. 2,882,156 discloses aminoguanidine derivatives. U.S. Pat. Nos. 3,625,694, 3,859,096 and British Pat. No. 1,277,453 disclose mordants which are cross-linkable with gelatin, etc.

U.S. Pat. Nos. 3,958,995, 2,721,852 and 2,798,063 disclose aqueous sol type mordants.

Also, Japanese Patent Application (OPI) No. 61228/75 and Japanese Patent Application (OPI) No. 128336/79 disclose water-insoluble mordants.

Other examples of various mordants used in this invention are described in U.S. Pat. Nos. 3,709,690 and 3,788,855, West German Patent Application (OLS) No. 2,843,320, Japanese Patent Application (OPI) Nos. 30328/78, 155528/77, 125/78 and 1024/78, U.S. Pat. Nos. 3,642,482, 3,488,706, 3,557,066, 3,271,147, and 3,271,148, and Japanese Patent Application (OPI) NO. 71332/75.

It is preferred that the mordant used in this invention be reluctant to move from a mordanting layer to other photographic layer or layers in a photographic unit and for the purpose various attempts that a mordant is cross-linked with a matrix such as gelatin as mentioned above or a water-insoluble mordant is coated as a solution of a mixture of water and an organic solvent or as an emulsified dispersion thereof, or further as an aqueous sol or latex dispersion thereof have been practiced.

The invention is further described by the following examples.

COMPARISON EXAMPLE

A masking material (comparison sample) was prepared by coating a coating solution having the following composition on the both surfaces of a biaxially stretched polyester film of 50 microns thick and drying to form adhesive layers each having 5 microns thick.

| | |
|---|---|
| EVAFLEX-360 (trade name of a copolymer of 25 wt % vinyl acetate and 75 wt % ethylene, melt index 2, made by Mitsui Petrochemical Industries, Ltd.) | 40 g |
| CALIFLEX TR 110 (trade name of a block polymer of styrene and butadiene, made by Shell Oil Company) | 20 g |
| CASTER WAX (trade name of higher fatty acid ester, made by Nissan Chemical Industries, Ltd.) | 6 g |
| PETROZIN (trade name of petroleum resin, made by Mitsui Petrochemical Industries, Ltd.) | 30 g |
| 2,2'-Methylenebis(4-methyl-6-t-butylphenol) | 0.6 g |
| Toluene | 5 l |

EXAMPLE 1

A masking material (Sample A) was prepared in the same manner as in the Conparison Example except that benzoic anhydride was added to the coatng composition for adhesive layers in an amount of 10% by weight of EVAFLEX-360.

EXAMPLE 2

A masking material (Sample B) was prepared by the same manner as in Example 1 using benzoic acid in place of benzoic anhydride.

EXAMPLE 3

A masking material (Sample C) was prepared by the same manner as in Example 1 using salicylic acid in place of benzoic anhydride.

EXAMPLE 4

A masking material (Sample D) was prepared by the same manner as in Example 1 using palmitic acid in place of benzoic anhydride.

Preparation of photosensitive sheet

The following layers were successively coated on a biaxially stretched polyester film having 150 micron thick, wherein the numeral in the parenthesis is a coated amount shown by the unit of g/m$^2$.

(1) Image-receiving layer containing 4.0 g/m$^2$ of copoly[styrene-N-vinylbenzyl-N,N,N-trihexylammonium chloride] and 4.0 g/m$^2$ of gelatin.

(2) White reflective layer containing 22 g/m$^2$ of titanium dioxide and 2.2 g/m$^2$ of gelatin.

(3) Opaque layer containing 2.7 g/m$^2$ of carbon black and 2.7 g/m$^2$ of gelatin.

(4) Layer containing 0.50 g/m$^2$ of the cyan dye-releasing redox compound having the following structure together with 0.50 g/m$^2$ of N,N-diethyllaurylamide and 1.5 g/m$^2$ of gelatin:

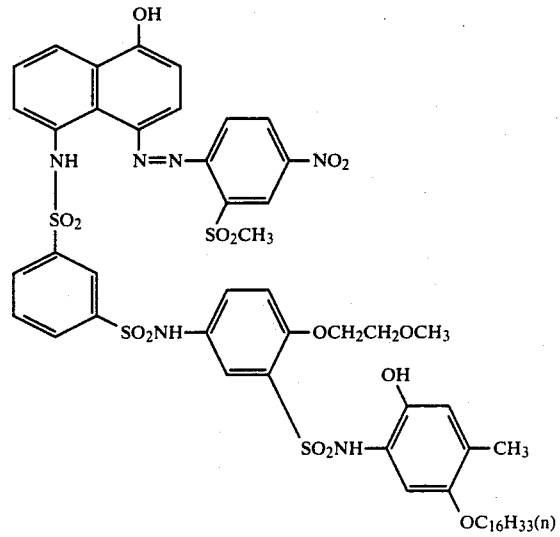

(5) Layer containing a red-sensitive internal latent image type silver halide emulsion (1.1 g/m$^2$ of gelatin and 1.4 g/m$^2$ of silver), 0.015 g/m$^2$ of 1-acetyl-2-[4-(2,4-di-t-pentylphenoxyacetamido)phenyl]hydrazine, and 0.067 g/m$^2$ of sodium 2-pentadecylhydroquinone-5-sulfonate.

(6) Color mixing preventing agent-containing layer containing 1.0 g/m$^2$ of gelatin, 1.0 g/m$^2$ of an eutectic mixture of 2,5-di-t-pentadecylhydroquinone, and 0.25 g/m$^2$ of a copolymer of polyvinylpyrrolidone and vinyl acetate in 7:3 by mol ratio.

(7) Layer containing 0.80 g/m$^2$ of the magenta dye releasing redox compound having the following structure, 0.20 g/m$^2$ of N,N-diethyllaurylamide, and 1.2 g/m$^2$ of gelatin:

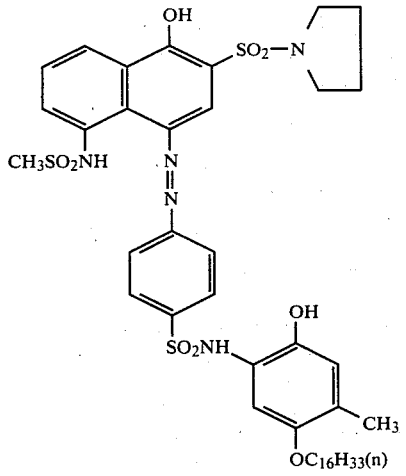

(8) Layer containing a green-sensitive internal latent image type silver iodobromide emulsion (1.1 g/m$^2$ of gelatin and 1.4 g/m$^2$ of silver), 0.015 g/m$^2$ of 1-acetyl-2-[4-(2,4-di-t-pentylphenoxyacetamido)phenyl]-hydrazine, and 0.067 g/m$^2$ sodium 2-pentadecylhydroquinone-5-sulfonate.

(9) Color mixing preventing agent-containing layer containing 1.0 g/m$^2$ of gelatin, 1.0 g/m$^2$ of an eutectic mixture of 2,5-di-t-pentadecylhydroquinone, and 0.25 g/m$^2$ of a copolymer of polyvinylpyrrolidone and vinyl acetate in 7:3 by mol ratio.

(10) Layer containing 0.45 g/m$^2$ of the yellow dye releasing redox compound described by following formula [A], 0.55 g/m$^2$ of the yellow dye releasing redox compound described by following formula [B], 0.25 g/m$^2$ of N,N-diethyllaurylamide, and 1.0 g/m$^2$ of gelatin:

[A]

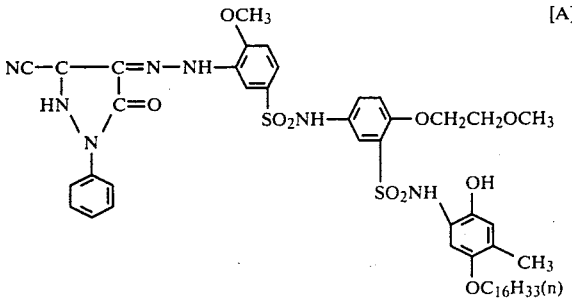

-continued

[B]

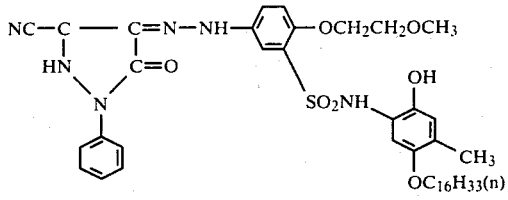

(11) Layer containing a blue-sensitive internal latent image type silver iodobromide emulsion (1.1 g/m$^2$ of gelatin and 1.4 g/m$^2$ of silver), 0.015 g/m$^2$ of 1-acetyl-2-[4-(2,4-di-t-pentylphenoxyacetamido)phenyl] hydrazine, and 0.067 g/m$^2$ of sodium 2-pentadecylhydroquinone-5-sulfonate.

(12) Protective layer containing 1.3 g/m$^2$ of gelatin, 0.09 g/m$^2$ of a latex of polyethyleneacryl acrylate, 0.5 g/m$^2$ of Tinuvin, and 0.026 g/m$^2$ of a hardening agent, trisacryloyl perhydrotriazine.

Composition of viscous processing solution:

The processing solution having the following composition was prepared and 1.1 ml each of the processing solution was packed in a pressure-rupturable container under a nitrogen atmosphere.

Water: 820 ml
1N Sulfuric acid: 5 ml
Hydroxyethyl cellulose: 60 g
4-Hydroxymethyl-4-methyl-1-phenyl-3-pyrazolidone: 5 g
5-Methylbenzotriazole: 2 g
t-Butylhydroquinone: 0.4 g
Sodium sulfite (anhydrous): 2 g
Carbon black: 150 g
Sodium hydroxide: 30 g Cover sheet:

The following layers were successively coated on a biaxially stretched transparent polyester film of 100 micron thick and dried:

(1) Layer containing 22 g/m$^2$ of a copolymer (having a viscosity of about 4,000 cp in a mixture of 25% by weight water and acetone) of acrylic acid and butyl acrylate in 80:20 by weight ratio and 0.44 g/m$^2$ of 1,4-bis(2,3'-epoxypropoxy)butane.

(2) Layer containing 3.8 g/m$^2$ of acetyl cellulose (forming 39.4 g of acetyl group by hydrolyzing 100 g of the acetyl cellulose), 0.2 g/m$^2$ of poly(styrene-co-maleic anhydride) (component ratio: styrene: maleic anhydride=about 60:40, molecular weight of about 50,000), and 0.115 g/m$^2$ of 5-($\beta$-cyanoethylthio)-1-phenyl-tetrazole.

(3) Layer containing 2.5 g/m$^2$ of a latex of a copolymer of vinylidene chloride, methyl acrylate, and acrylic acid in 85:12:3 by weight ration and 0.05 g/m$^2$ of polymethyl methacrylate latex (particle size of 1–3 microns).

Preparation of spacer rail material:

Adhesive layers each of 5 micron thick as in the comparison example were formed on the both surfaces of a biaxially stretched transparent polyester film having 20 micron thick.

Trap material:

The trap material was prepared by impregnating a nylon mesh having impregnated therein methyl cellulose with tartaric acid.

Figure 2:
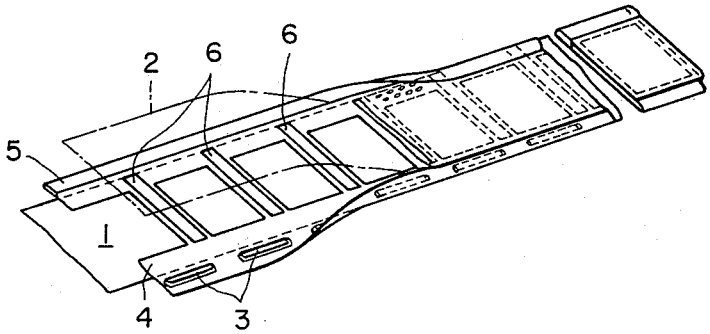
FIG. 2 is a view showing a technique for assembling photographic film units according to the invention.

Assembling of photographic film unit:

A photographic film unit was assembled as shown in FIG. 1 and FIG. 2 using the masking material, spacer rail material, photosensitive sheet, processing composition-containing container, and cover sheet illustrated above.

FIG. 1 is a view, partially in section, showing a finished photographic film unit. As shown in the figure, a masking material 4 having a large rectangular opening is superposed on a photosensitive sheet 1 and a cover sheet 2 and the photosensitive sheet 1 are fixed thereto by adhesion together with a spacer rail 6. A processing composition-containing container 3 is disposed at one end portion, a trap material 5 is disposed at the other end portion, they are covered with the masking material 4 folded, and the end portion of the masking material is fixed by adhesion to the back surface (opposite to the surface carrying a pH neutralization timing layer) of the cover sheet 2. They are all heatsealed at 120° C.

FIG. 2 shows a course of assembling photographic film units shown in FIG. 1. Onto a long photo-sensitive sheet 1 is fed a masking material 4 having rectangular large openings at the center portion thereof with a definite interval each other and having attached thereon spacer rails 6, and heat-sealed to the photo-sensitive sheet 1 at 120° C. Then, a trap material 5 and processing composition-containing containers 3 are attached successively. On the other hand, a long cover sheet 2 having a definite width is fed and superposed on the photosensitive sheet at a predetermined position. Thereafter, the end portion of the masking material having attached thereto the trap material and the end portion of the masking material having attached thereto processing composition-containing containers are folded respectively and each end of the masking material thus folded is heat-sealed to the back surface of the cover sheet 2. Finally, the laminated assembly is cut at a definite interval as shown in FIG. 2 to provide each finished photographic film unit. In the photographic film unit thus prepared, the four marginal portions sealed by the masking material, that is, the marginal portion A having a relatively wide width (as shown in FIG. 1) having disposed thereon the processing composition-containing container, the marginal portions B and D each having disposed thereon the spacer rail, and the marginal portion C having disposed thereon the trans material are free from the processing composition when it is spread in the film unit and form white frame or marginal portions of an image print.

Diffusion transfer photographic processing:

After imagewise exposing the photographic film unit thus prepared, the film unit was passed through a pair of press rolls to distribute the processing composition between the photosensitive sheet and the cover sheet. After 1 hour since the development, the transfer print thus obtained was allowed to stand for 3 days in a room kept at 60° C. and 80% in relative humidity and then the staining extent of the edges of the photosensitive sheet side and the white frame or marginal portions was observed. The results are shown in Table 1. The stain was measured in yellow density at the marginal portion A by means of a Macbeth reflection densitometer.

TABLE 1

| Sample | Masking Material | $D_B$ (60° C.-80% RH, 3 days) |
|---|---|---|
| 1 | Comparison | 0.46 |
| 2 | Sample A | 0.27 |
| 3 | Sample B | 0.28 |
| 4 | Sample C | 0.28 |
| 5 | Sample D | 0.36 |

As is clear from Table 1, when the masking materials and the acid or the acid-releasing compound according to this invention are used, the stain of the white marginal portions was remarkably reduced.

Also, yellow and magenta color stains were severe at the marginal portions of the image print in the Comparison Sample, but the samples of this invention were much less affected.

While the invention has been described in detail and with reference to specific embodiments thereof, it will be apparent to one skilled in the art that various changes and modifications can be made therein without departing from the spirit and scope thereof.

What is claimed is:

1. An integral diffusion transfer photographic film unit comprising at least one photosensitive silver halide emulsion layer in association with a dye-image-providing material and an image-receiving layer positioned between two support layers, at least one of said supports being transparent, and also containing a processing composition to be distributed between said two support layers, wherein at least one marginal portion of said integral film unit is masked by a masking material having on a surface facing said integral film unit a pressure-sensitive or heat-sensitive adhesive layer containing an acid or an acid-releasing material.

2. An integral diffusion transfer photographic film unit as in claim 1, wherein the acid or the acid-releasing material is an aromatic carboxylic acid or an acid anhydride thereof.

3. An integral diffusion transfer photographic film unit as in claim 1, wherein the acid or the acid-releasing material is an aliphatic carboxylic acid or an acid anhydride thereof.

4. An integral diffusion transfer photographic film unit as in claim 1, wherein said dye image-providing material is a DRR compound.

5. An integral diffusion transfer photographic film unit as in claim 1, wherein the adhesive layer contains a heat-sensitive adhesive.

6. An integral diffusion transfer photographic film unit as in claim 1, wherein said acid or the acid-releasing material is benzoic acid, salicylic acid, or an acid anhydride thereof.

7. An integral diffusion transfer photographic film unit as in claim 1, wherein said photographic film unit comprises, in sequence, a transparent support, an image-receiving layer, an opaque layer, and at least one silver halide photographic emulsion layer in association with a dye image-providing material.

8. An integral diffusion transfer photographic film unit as in claim 3, wherein said aliphatic carboxylic acid is acetic acid, propionic acid, palmitic acid, stearic acid, succinic acid, or acid anhydrides thereof.

9. An integral diffusion transfer photographic film unit as in claim 1, wherein said heatsensitive adhesive layer used contains copolymers containing from about 18 to 40% by weight vinyl acetate.

* * * * *